US010500858B2

(12) United States Patent
Lutnesky et al.

(10) Patent No.: US 10,500,858 B2
(45) Date of Patent: Dec. 10, 2019

(54) PRINTED CIRCUIT BOARD FLUID EJECTION APPARATUS

(71) Applicant: HEWLETT-PACKARD DEVELOPMENT COMPANY, L.P., Houston, TX (US)

(72) Inventors: Gary G. Lutnesky, Corvallis, OR (US); Silam J. Choy, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/918,411

(22) Filed: Mar. 12, 2018

(65) Prior Publication Data

US 2018/0201017 A1 Jul. 19, 2018

Related U.S. Application Data

(63) Continuation of application No. 15/114,002, filed as application No. PCT/US2014/013730 on Jan. 30, 2014, now Pat. No. 9,962,936.

(51) Int. Cl.

| | |
|---|---|
| ***B41J 2/14*** | (2006.01) |
| ***B41J 2/16*** | (2006.01) |
| ***B41J 2/155*** | (2006.01) |
| *B41J 2/165* | (2006.01) |

(52) U.S. Cl.

CPC ..... *B41J 2/1433* (2013.01); *B41J 2/155* (2013.01); *B41J 2/162* (2013.01); *B41J 2/1623* (2013.01); *B41J 2/1637* (2013.01); *B41J 2/16535* (2013.01); *B41J 2002/14491* (2013.01); *B41J 2202/11* (2013.01); *B41J 2202/19* (2013.01); *B41J 2202/20* (2013.01)

(58) Field of Classification Search

CPC ..... B41J 2/1433; B41J 2/155; B41J 2/1623

See application file for complete search history.

(56) References Cited

U.S. PATENT DOCUMENTS

| | | | | |
|---|---|---|---|---|
| 6,188,414 | B1 | 2/2001 | Wong et al. | |
| 6,652,073 | B2 | 11/2003 | Chou et al. | |
| 8,438,730 | B2 | 5/2013 | Ciminelli | |
| 2003/0090558 | A1* | 5/2003 | Coyle | B41J 3/36 347/109 |
| 2003/0122897 | A1 | 7/2003 | Chou | |
| 2008/0299361 | A1 | 12/2008 | Anderson | |
| 2009/0066759 | A1* | 3/2009 | Mulay | B41J 2/1601 347/54 |
| 2009/0079793 | A1 | 3/2009 | Chung-Long-Shan et al. | |
| 2010/0132874 | A1* | 6/2010 | Anderson | B41J 2/14129 156/89.12 |

FOREIGN PATENT DOCUMENTS

| | | |
|---|---|---|
| CN | 1805652 A | 7/2006 |
| EP | 0822078 | 2/1998 |

(Continued)

*Primary Examiner* — Jason S Uhlenhake

(74) *Attorney, Agent, or Firm* — HP Inc. Patent Department

(57) ABSTRACT

In an example, a fluid ejection apparatus includes a printed circuit board including a conductor layer, a cover layer forming a surface of the printed circuit board, and a cavity. A printhead die may be embedded in a molding material in the cavity.

19 Claims, 8 Drawing Sheets

(56) References Cited

FOREIGN PATENT DOCUMENTS

| | | | |
|---|---|---|---|
| EP | 1095773 | | 5/2001 |
| JP | 60-192659 | | 10/1985 |
| JP | 2001-150680 | A | 6/2001 |
| WO | WO-2006112526 | | 10/2006 |
| WO | WO-2014133633 | | 9/2014 |

* cited by examiner

PRINTED CIRCUIT BOARD FLUID EJECTION APPARATUS

BACKGROUND

Printhead dies in an inkjet pen or print bar may include channels that carry fluid, such as ink, to the ejection chambers. Ink may be distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, may require changes to the larger structures that support the dies, including the passages that distribute ink to the dies.

BRIEF DESCRIPTION OF THE DRAWINGS

The detailed description section references the drawings, wherein.

Figure 1:
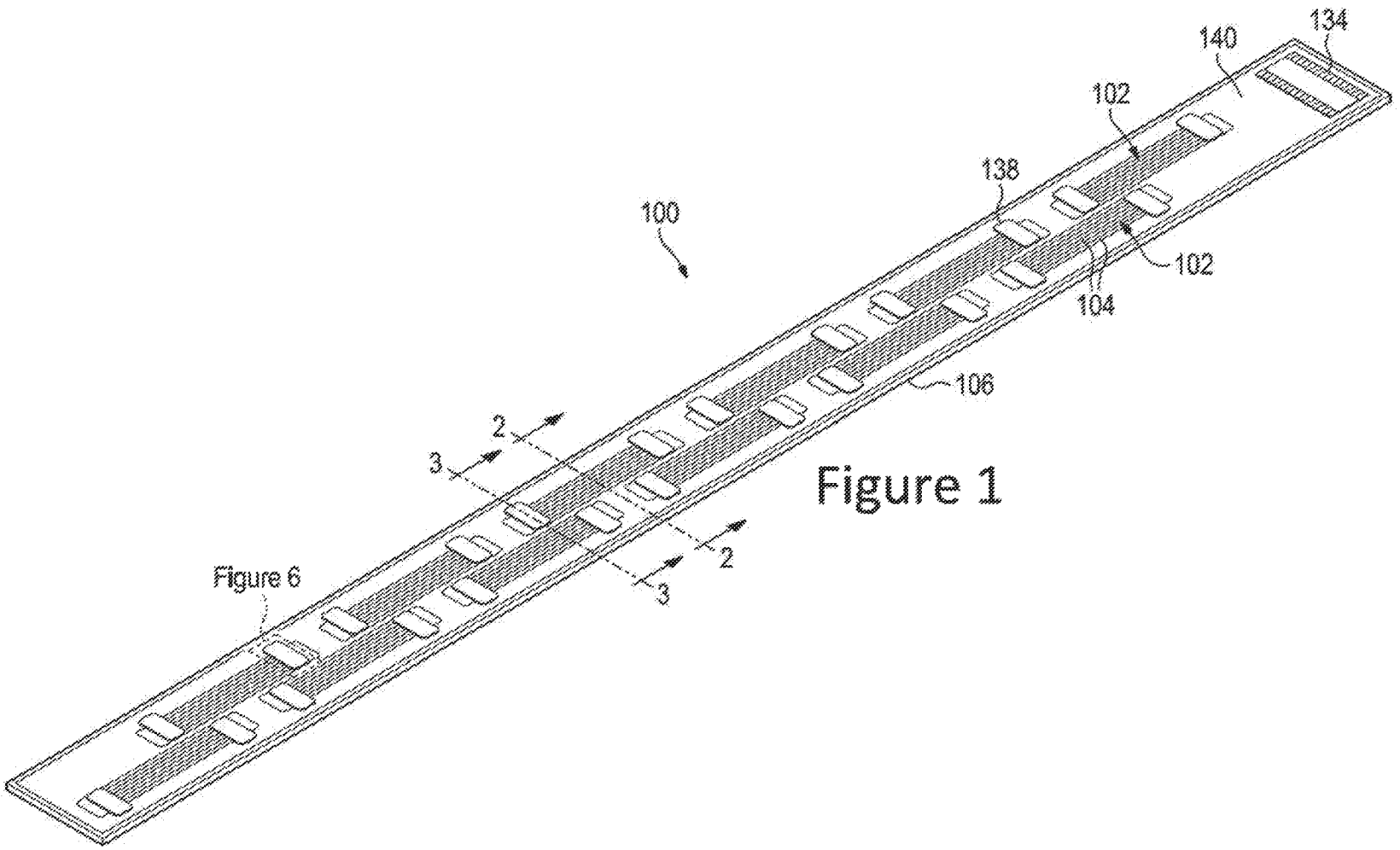
FIGS. 1-3 illustrate an inkjet print bar implementing an example of a fluid ejection apparatus.

all in which various embodiments may be implemented.

Examples are shown in the drawings and described in detail below. The drawings are not necessarily to scale, and various features and views of the drawings may be shown exaggerated in scale or in schematic for clarity and/or conciseness. The same part numbers may designate the same or similar parts throughout the drawings.

DETAILED DESCRIPTION

Inkjet printers that utilize a substrate wide print bar assembly have been developed to help increase printing speeds and reduce printing costs. Conventional substrate wide print bar assemblies include multiple parts that carry printing fluid from the printing fluid supplies to the small printhead dies from which the printing fluid is ejected on to the paper or other print substrate. While reducing the size and spacing of the printhead dies continues to be important for reducing cost, channeling printing fluid from the larger supply components to ever smaller, more tightly spaced dies requires complex flow structures and fabrication processes that can actually increase cost.

Described herein are various implementations of a fluid ejection structure enabling the use of smaller printhead dies and more compact die circuitry to help reduce cost in substrate wide inkjet printers. A printhead structure implementing an example of the fluid ejection structure may include a printed circuit board including a conductor layer, a cover layer over the conductor layer, and a cavity to accommodate at least printhead die. Multiple printhead dies may be embedded, glued, or otherwise mounted in cavities in the printed circuit board such that drop ejectors of the printhead dies are exposed at a surface of the printed circuit board. In various implementations, the cover layer may protect the underlying conductor layer from corrosion through exposure to printing fluid (e.g., ink) and other moisture, provide a substantially planar and durable surface against wiping during operation of the fluid ejection apparatus with high resistance to wear and low friction, and protect against molding material flowing into the area of the bond pads.

In various implementations, the printed circuit board in effect grows the size of each printhead die for making fluid and electrical connections and for attaching the printhead dies to other structures, thus enabling the use of smaller dies. For the various implementations described herein, a printed circuit board fluid ejection apparatus may enable the use of long, narrow and very thin printhead dies. For example, a 100 μm thick printhead die that is about 26 mm long and 500 μm wide can be embedded in a 1 mm thick printed circuit board to replace a conventional 500 μm thick silicon printhead die. The ease with which printed circuit boards can be fabricated and processed may also help simplify the fabrication of page wide print bars and other printhead structures as new, composite structures with built-in printing fluid channels, eliminating the difficulties of forming the printing fluid channels in a substrate.

In various implementations, the fluid ejection structure may not be limited to print bars or other types of printhead structures for inkjet printing, but may be implemented in other devices and for other fluid flow applications. Thus, in one example, the fluid ejection structure may include a micro device embedded in a printed circuit board having fluid feed slots and channels therein through which fluid may flow to the micro device. The micro device, for example, could be an electronic device, a mechanical device, or a microelectromechanical system (MEMS) device. The fluid flow, for example, could be a cooling fluid flow into or onto the micro device or fluid flow into a printhead die or other fluid dispensing micro device.

As used herein, a "printed circuit board" (sometimes abbreviated "PCB") means a non-conductive substrate with conductive pathways for mechanically supporting and electrically connecting to an electronic device and may comprise a stack of a plurality of layers such as, for example, prepreg layers and conductor layers comprising metal; a "micro device" means a device, such as a printhead die, etc., having one or more exterior dimensions less than or equal to 30 mm; "thin" means a thickness less than or equal to 650 μm; a "sliver" means a thin micro device having a ratio of length to width (UW) of at least three; a "printhead" and a "printhead die" mean that part of an inkjet printer or other inkjet type dispenser that dispenses fluid from one or more openings. A printhead includes one or more printhead dies. "printhead" and "printhead die" are not limited to printing with ink and other printing fluids but also include inkjet type dispensing of other fluids and/or for uses other than printing.

Figure 2:
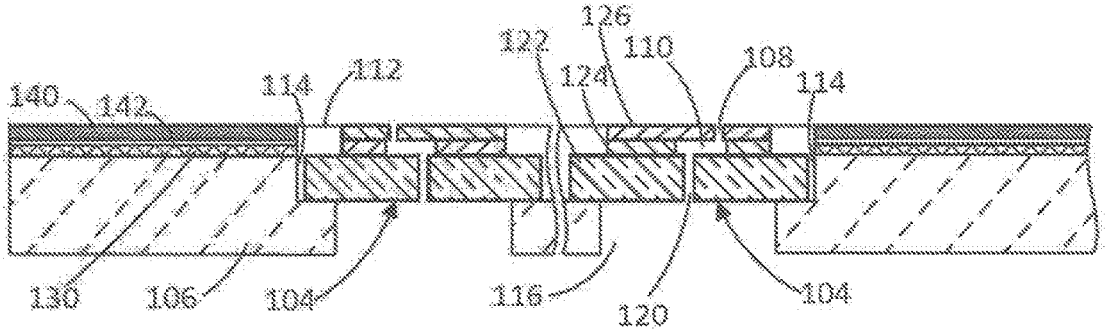
Figure 3:
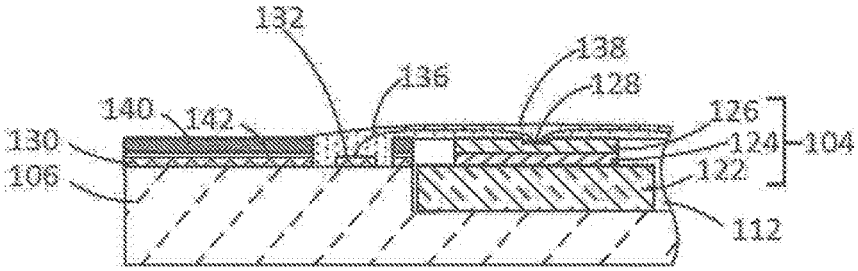
Figure 4:
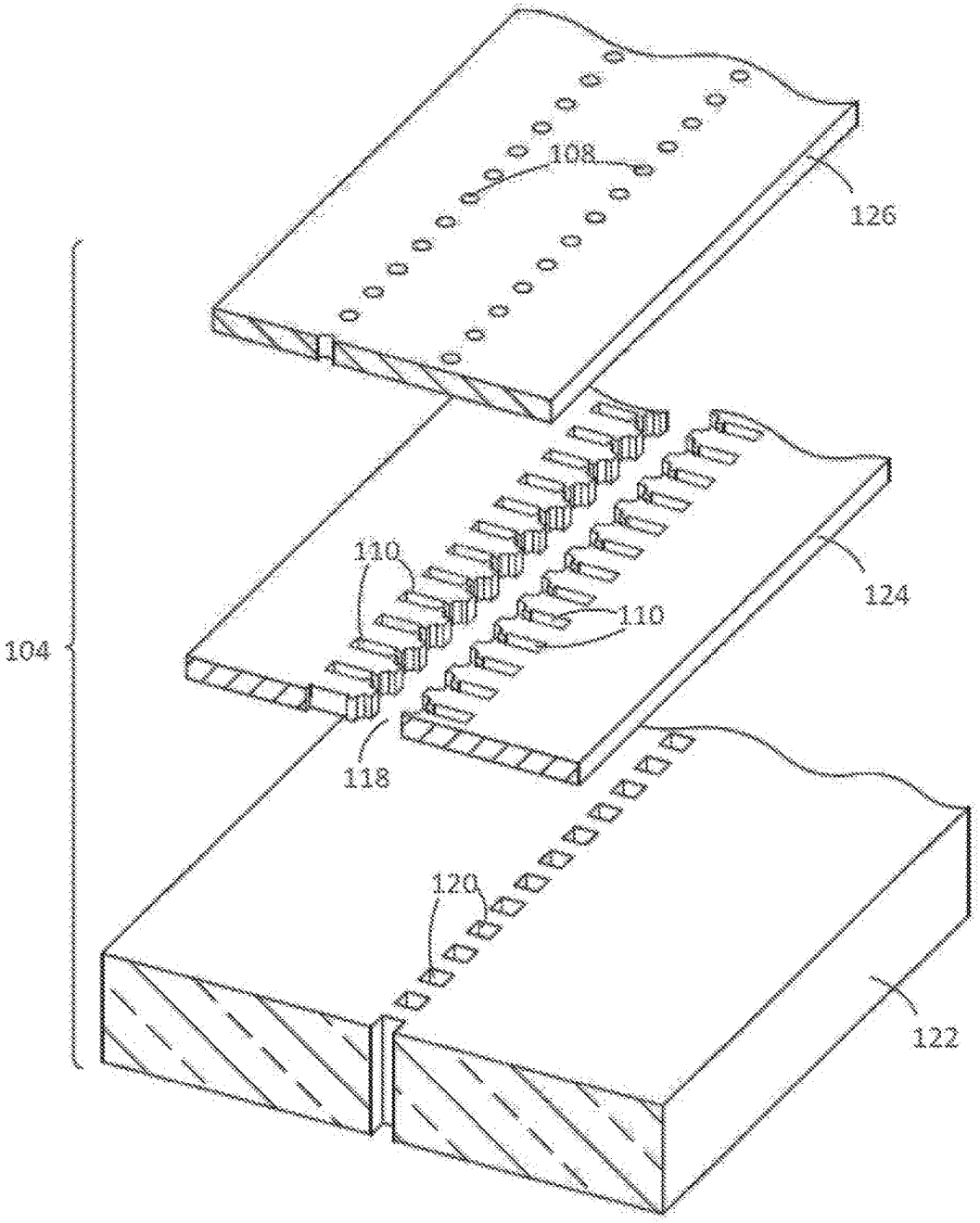
FIGS. 4 and 5 illustrate an example printhead die for implementing a fluid ejection apparatus.
Figure 5:
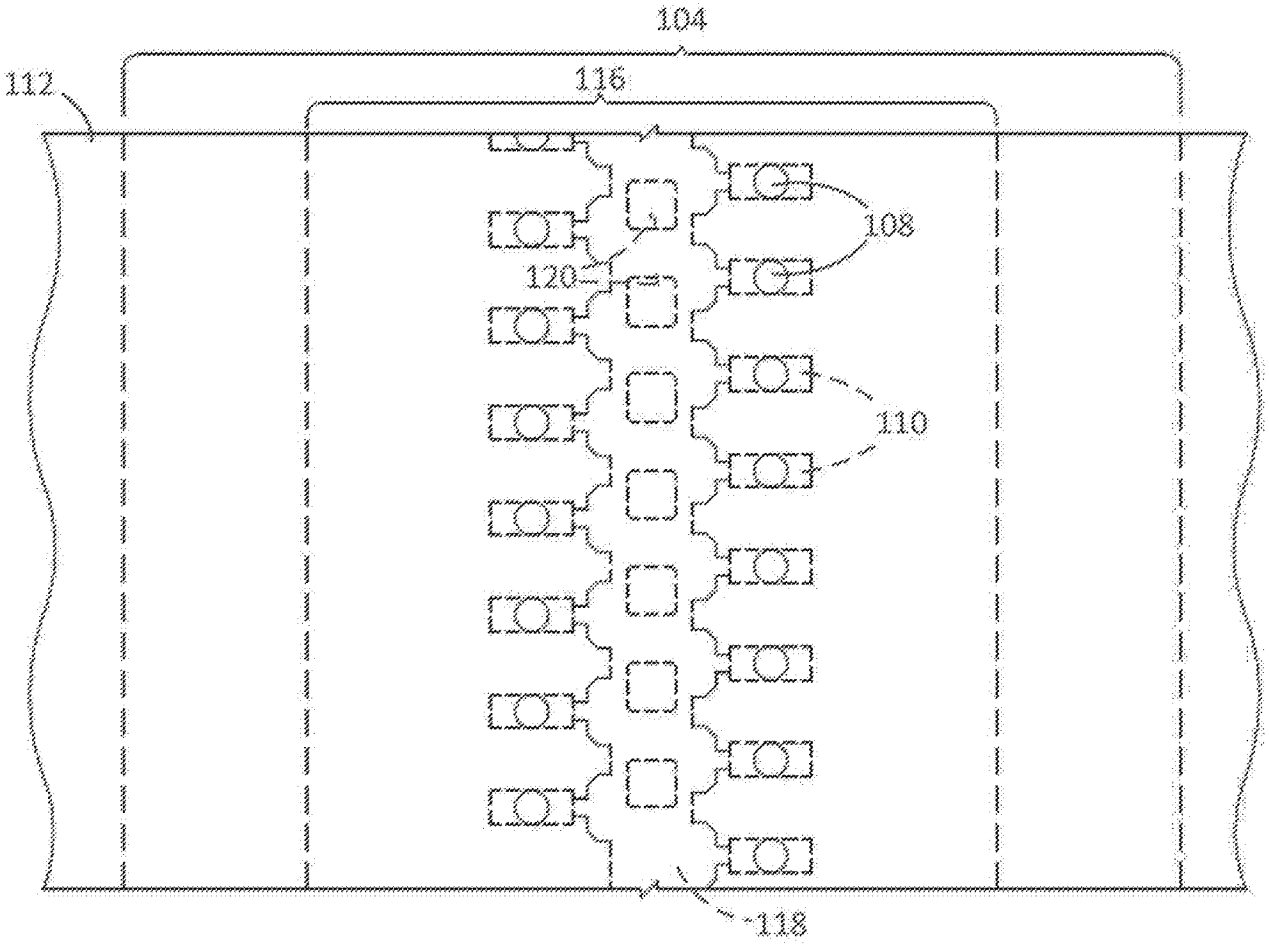
Figure 6:
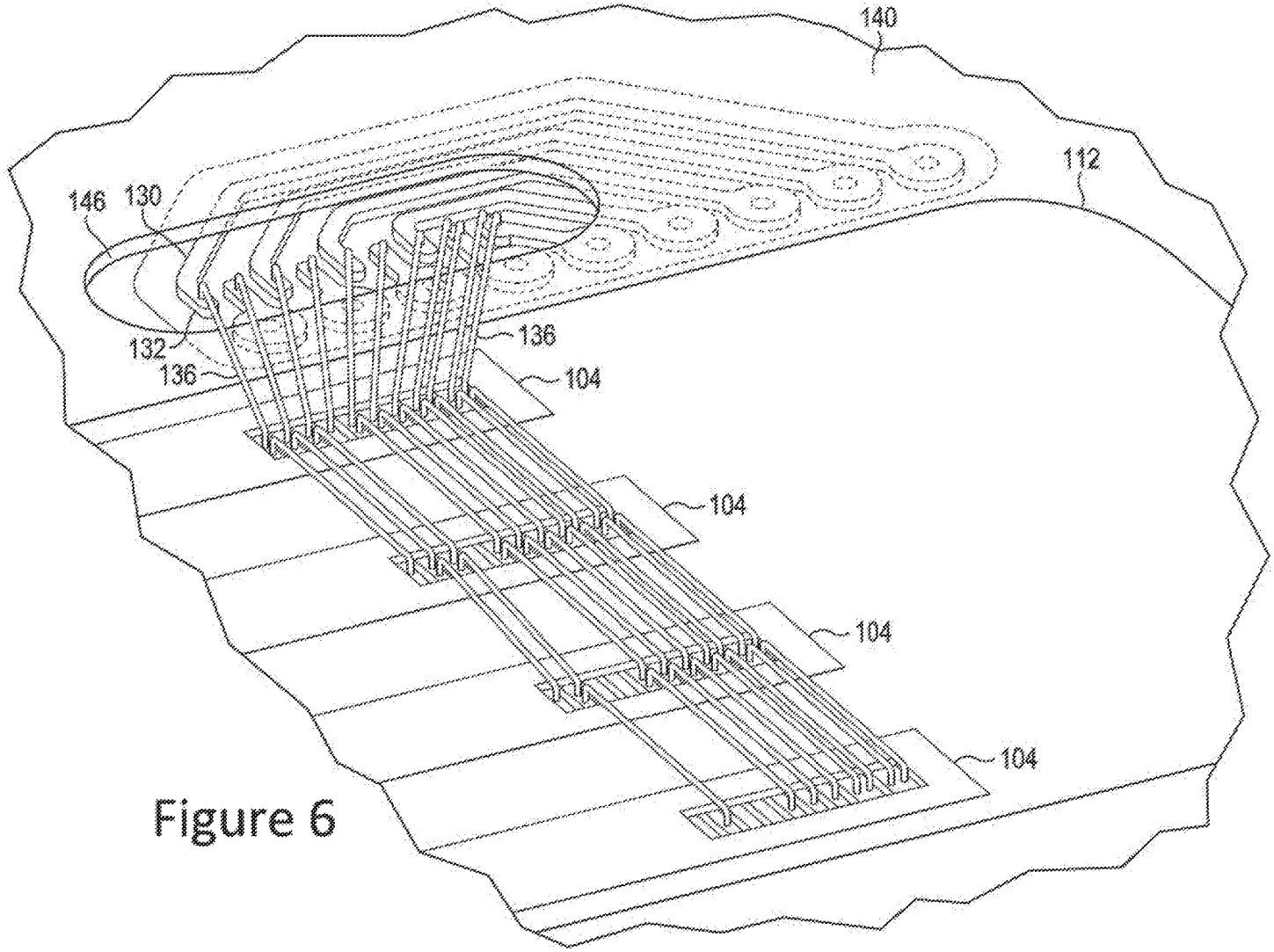
FIG. 6 is a detailed view of the fluid ejection apparatus of FIG. 1.

FIGS. 1-3 are various views of an example a fluid ejection apparatus 100 in which printhead dies 104 are embedded in a printed circuit board. FIGS. 4 and 5 are detailed views of one of the die slivers 104 shown in FIGS. 1-3, FIG. 6 is a detailed view of the electrical connections between the die slivers 104 and the printed circuit board 106. In the illustrated example, the fluid ejection apparatus 100 may be configured as an elongated print bar such as might be used in a single pass substrate wide printer.

The fluid ejection apparatus 100 may include a plurality of printheads 102 embedded in an elongated printed circuit board 106 and arranged generally end to end in a row lengthwise in a staggered configuration in which the printheads 102 in the row overlap another printhead 102 in that row. Each of the printheads 102 may include at least printhead die sliver 104. Although ten printheads 102 are shown in a staggered configuration, more or fewer printheads 102 may be used and/or may be arranged in a different configuration. Likewise, although each of the printheads 102 is illustrated as having four printhead die slivers 104, more or fewer printhead die slivers 104 may be used and/or may be arranged in a different configuration. In addition, although one row of staggered printheads 102 is shown, more rows may be possible. For example, in some configurations, a fluid ejection apparatus may include multiple rows of printheads 102, and in at least some of these configurations, multiple rows of printheads 102 may print multiple different color.

Each printhead 102 may include a single printhead die sliver 104 or multiple die slivers 104, each sliver 104 with at least one row of drop ejectors 108 exposed at a surface of the printed circuit board 106 through which printing fluid may be ejected from corresponding fluid ejection chambers 110. The printhead dies 104 may be coupled to the printed circuit board 106 using a die attach adhesive or molding material 112. As illustrated, for example, the printhead dies 104 are embedded in a molding material 112 in a cavity (defined by walls 114) of the printed circuit board 106 to couple the printhead dies 104 within the printed circuit board 106.

The fluid ejection apparatus 100 may include a fluid feed slot/channel 116 at a surface opposite the exposed drop ejectors 108 in the printed circuit board 106 to supply printing fluid to each printhead die sliver 104. In various implementations, the fluid feed slot/channel 116 may comprise a plunge-cut fluid feed slot extending through the surface of the printed circuit board 106 to expose the printhead die 104. Other suitable configurations for each printhead 102 may be possible. For example, more or fewer printhead die slivers 104 may be used with more or fewer ejection chambers 110 and fluid feed slots 116 or larger dies (not slivers) may be used.

Printing fluid may flow into each ejection chamber 110 from a manifold 118 extending lengthwise along each die sliver 104 between the two rows of ejection chambers 110. Printing fluid may feed into the manifold 118 through multiple ports 120 that are connected to the printing fluid feed slot/channel 116 at the bottom surface of the die 104. The idealized representation of a printhead die 104 in FIGS. 2-5 depicts three layers 122, 124, 126 for convenience only to clearly show ejection chambers 110, drop ejectors 108, manifold 118, and ports 120. An actual inkjet printhead die sliver 104 may be a typically complex integrated circuit (IC) structure formed on a silicon substrate 122 with layers and elements not shown in FIGS. 1-5, For example, a thermal ejector element or a piezoelectric ejector element formed (not shown) on substrate 122 at each ejection chamber 110 may be actuated, via electrical terminals 128, to eject drops or streams of ink or other printing fluid from drop ejectors 108.

The printed circuit board 106 may include a plurality of layers including at least one conductor layer 130. In many implementations, the printed circuit board 106 may include alternating layers of conductor layers and insulating layers, and may include redistribution layers or conductive pathways electrically connecting various parts of the conductor layers to each other and/or to a component external to the printed circuit board 106. As such, although FIGS. 2 and 3 depict the apparatus 100 as including a single conductor layer 130 for the simplicity, it is contemplated that the printed circuit board 106 may include additional conductor layers. For example, the printed circuit board 106 may include a conductor layer at both surfaces of the printed circuit board 106 (e.g., conductor layer 103 at the first surface and another conductor layer the second surface, opposite the first surface, of the printed circuit board 106).

The conductor layer 130 may include at least one bond pad 132 electrically connected to an electrical terminal 128 of at least one of the printhead dies 104. The conductor layer 130 may carry electrical signals to the drop ejectors 108 and/or other elements of the printhead dies 104, and in some implementations, may be electrically connected to an ASIC or other non-printhead die electronic device 134 embedded in the printed circuit board 106. In at least some implementations, the conductor layer 130 may include a ground layer, which may allow for electrostatic discharge. In some implementations, the printhead dies 104 may be electrically connected to each other. In the example shown, the conductor layer 130 may be electrically connected to the printhead dies 104 through bond wires 136. As shown, the bond wires 136 may be encapsulated in an encapsulant material 138. Although the illustrated examples depict printhead dies 104 wire-bonded to the printed circuit board 106, other electrical interconnection arrangements may be possible within the scope of the present disclosure. For example, in some implementations, a printhead die 104 may be electrically interconnected to a printed circuit board 106 by solder, conductive adhesive, or the like. It should be noted that the encapsulant material 138 is omitted in FIG. 6 so as to show the underlying wire bond connections.

Figure 7:
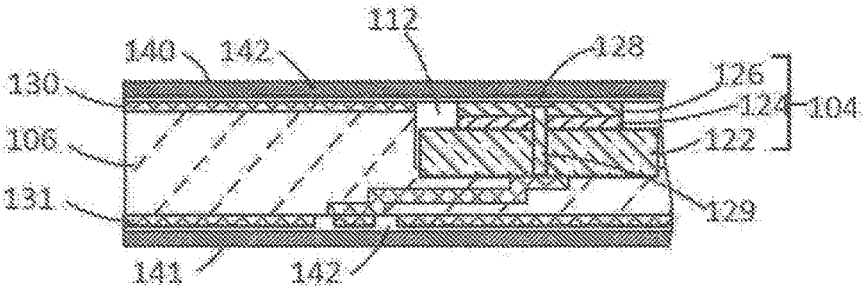
FIG. 7 illustrates another example fluid ejection apparatus.

In some implementations, rather than electrically connecting a top surface of the printhead die 104 to the printed circuit board 106, as illustrated in FIGS. 1-3 and 6, a printhead die 104 may instead have a through-silicon via 129, as illustrated in FIG. 7, to electrically connect the an electrical terminal 128 of the printhead die 104 to a conductor layer 131 at a bottom surface of the printed circuit board 106. In some of these implementations, the printhead die 104 may be electrically connected to the conductor layer 131 via a conductive pathway 133. In other implementations, the printhead die 104 may be electrically connected to the conductor layer 130 at the top surface of the printed circuit board 106 via another conductive pathway.

Figure 8:
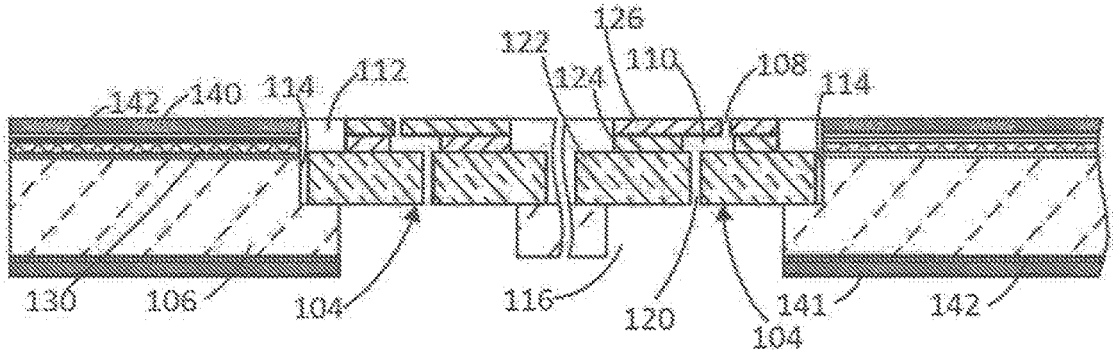
FIG. 8 illustrates another example fluid ejection apparatus.

As illustrated in FIGS. 1-3, 6, and 7, a fluid ejection apparatus may include a cover layer 140 on at least one of the surfaces of the printed circuit board. As illustrated in FIGS. 1-3 and 6, for example, the cover layer 140 may be formed over the conductor layer 130 at a top surface of the printed circuit board 106, while illustrated in FIGS. 7 and 8, the cover layer 140 may be formed at both the top surface and bottom surface of the printed circuit board 106. In various implementations, the cover layer 140 may be formed over a conductor layer 130/131, as shown in FIG. 7, or another layer of the printed circuit board 106, as shown in FIG. 8.

In various implementations, the cover layer 140 may comprise a polymer material such as, for example, polyimide, polyethylene naphthalate, or polyethylene terephthalate. In at least some implementations, the cover layer 140 may be coupled to the printed circuit board 106 by an adhesive layer 142 such as, for example, an epoxy adhesive. As illustrated in the Figures, the cover layer 140 may include an opening corresponding to the cavity (defined by walls 114) of the printed circuit board 106, and in some cases, may include one or more other openings, such as, for example, an opening 146 exposing a bond pad 132 of the conductor layer 130 in cases where the printhead die 104 is electrically connected to the printed circuit board 106 by a wires 136. In many of these implementations, the encapsulant material 138 may be formed to cover the opening 146 after the bond wires 136 are electrically coupled to the bond pad 132 and the electrical terminal 128 of the printhead die 104.

In various implementations, the cover layer 140 may form a barrier to protect the underlying conductor layer 130/131 or another layer of the printed circuit board 106 from corrosion from exposure to printing fluid (e.g., ink) and other moisture. In at least some implementations, the cover layer 140 may be able to provide protection not afforded by conventional solder resists or other materials, which may be reactive or otherwise unable to withstand exposure to printing fluid and/or mechanical wiping. The cover layer 140 may provide a substantially planar and durable surface against wiping during operation of the fluid ejection apparatus 100 with high resistance to wear and low friction.

As noted herein, the conductor layer may include a ground layer, electrostatic discharge current may be routed to ground via the ground layer In many cases, the ground layer of the printed circuit board 106 should not be left exposed to the printing fluid and wiping action. In various implementations, the cover layer 140 may have a voltage breakdown threshold, which may be controlled by the thickness of the cover layer 140, and electrostatic discharge currents may be allowed to burn through and route to ground via the ground layer. For example, a cover layer 140 comprising a 25 μm polyimide film will break down to safely route an electrostatic current when the voltage exceeds 4 kV.

In various ones of these implementations, the cover layer 140 and the molding material 112 may be level to each other so as to provide a continuously planar surface for wiping. In many implementations, the top layer 126 of the printhead die 104 may also be level to the cover layer 140 and the molding material 112 to facilitate wiping. In implementations in which a wire bond is encapsulated by an encapsulant material, the encapsulant material may be level or non-level to the cover layer 140 and the molding material 112. In at least some instances where the encapsulant material is not level to the cover layer 140 and the molding material 112, it may be desirable to form the encapsulant material with as low as possible profile to facilitate wiping across the surface of the fluid ejection apparatus.

Figure 9:
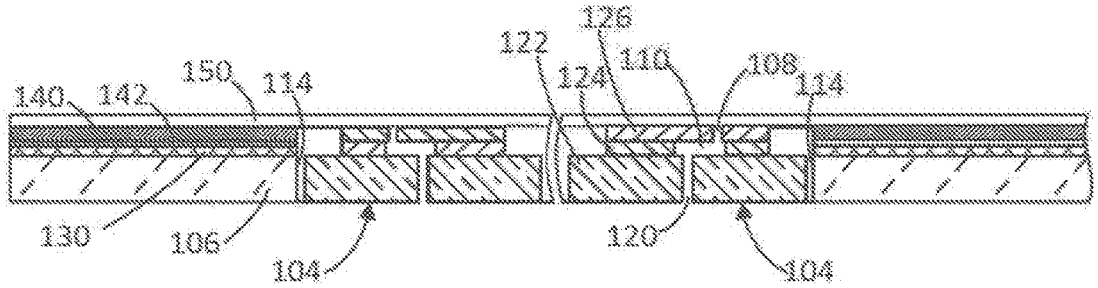
FIGS. 9-11 illustrate an example method for making a fluid ejection apparatus.
Figure 10:
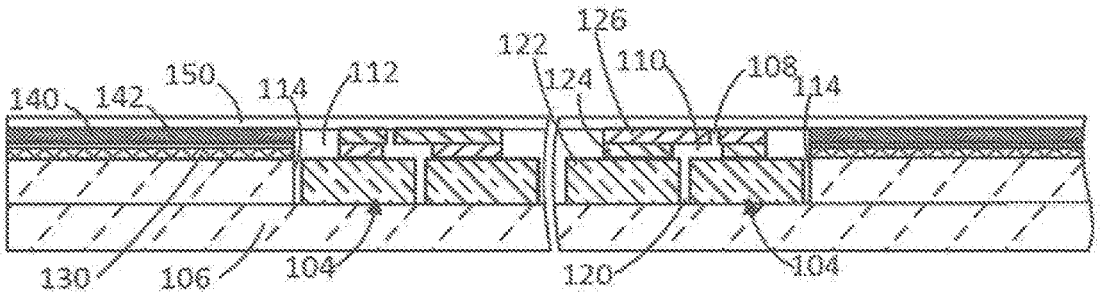
Figure 11:
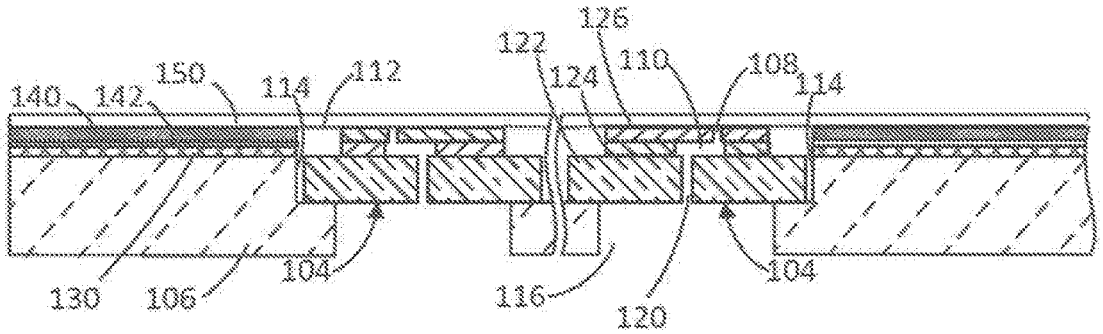

In various implementations, the cover layer 140 may be coupled to the printed circuit board 106 prior to embedding the printhead dies 104 in the printed circuit board 106, as illustrated in FIGS. 9-11. In these implementations, the cover layer 140 may effectively form a "dam" or flashing, which may inhibit the molding material 112 from flowing into the area around the bond pad 132 on the printed circuit board 106 when embedding the printhead dies 104 in the printed circuit board 106. FIGS. 9-11 describe an example method for forming the cover layer 140 and the molding material 112 such that the cover layer 140 and the molding material 112 are level to each other. As shown in FIG. 9, the cover layer 142 may be formed over the printed circuit board 106 and then a tape 150 or other level surface may be formed over at least a portion of the cover layer 140 and extending over the cavity (defined by walls 114) in which the printhead dies 104 may be set. The molding material 112 may then be flowed around the printhead dies 104 to embed the printhead dies 104 in the cavity of the printed circuit board 106.

In some implementations, the printed circuit board 106 used in FIG. 9 may be a first subset of printed circuit board layers, and in these implementations, a remaining subset of printed circuit board layers may be coupled to the first subset of printed circuit board layers after setting the molding material 112, as shown in FIG. 10. In some of these implementations, fluid feed slots 116 may be formed in the printed circuit board 106 after coupling the printed circuit board layers together, as shown in FIG. 11. In other implementations, the remaining subset of printed circuit board layers may include the fluid feed slots 116 prior to coupling to the first subset of printed circuit board layers of the printed circuit board 106. The tape 150 may then be removed to form the apparatuses described herein.

Figure 12:
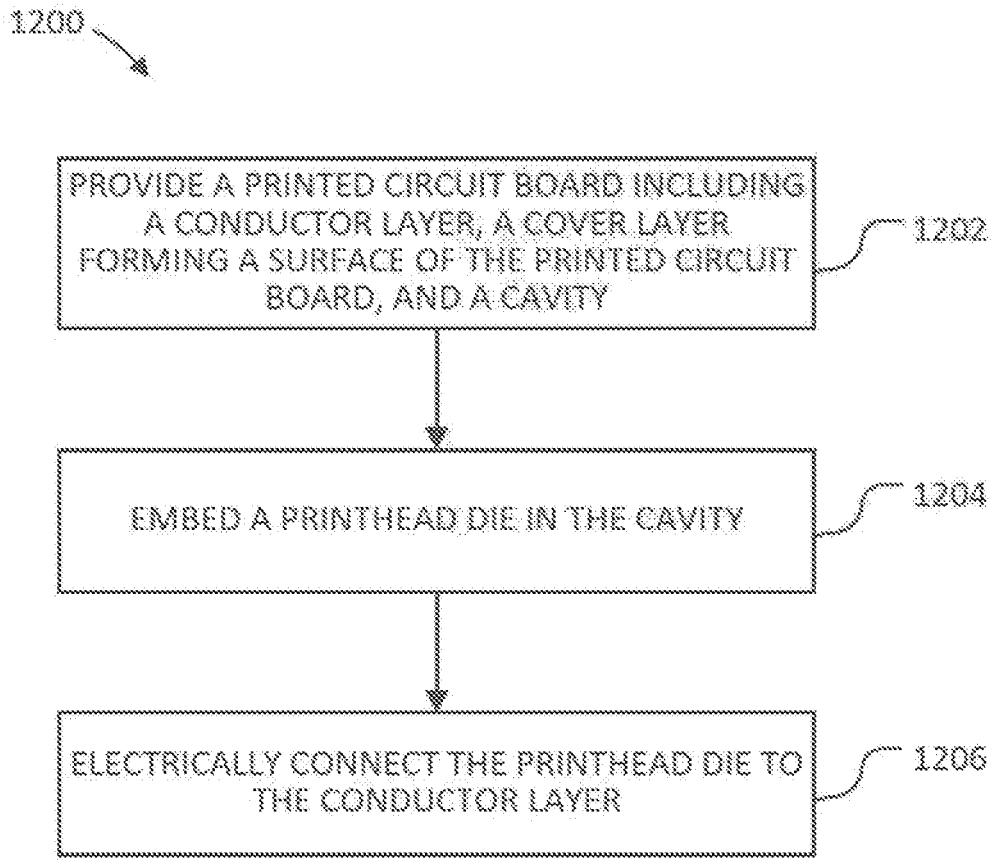
FIG. 12 is a flow chart illustrating another example of a method for making a fluid ejection apparatus.

FIG. 12 is a flow diagram illustrating another example method 1200 for making a fluid ejection apparatus, such as, for example, the fluid ejection apparatus 100 or printhead 102 described herein with reference to FIGS. 1-11 or other fluid ejection structures using other micro devices. The method 1200 may be associated with the various implementations described herein, and details of the operations shown in the method 1200 may be found in the related discussion of such implementations. It is noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

The method 1200 may begin or proceed with providing a printed circuit board including a conductor layer, a cover layer forming a surface of the printed circuit board, and a cavity at block 1202. As described herein, the conductor layer of the printed circuit board may include bond pads for interconnecting with a printhead die or other micro devices and a ground layer for providing electrostatic discharge protection. The cover layer may comprise any suitable material such as, for example, a polymer material. In various implementations, for example, the cover layer may comprise polyimide.

The method 1200 may proceed with embedding at least one printhead die in a molding material in the cavity such that the molding material is level with the cover layer. In preparation for receiving the printhead die, the cavity may be sawn or otherwise formed in the printed circuit board. In various implementations, a tape or other level surface may be formed over at least a portion of the cover layer and extending over the cavity and the printhead die may be set into the cavity from a bottom surface of the printhead die. In these implementations, the molding material may then be flowed around the printhead die to embed the printhead die in the cavity, with the molding material be formed to be level with the cover layer by virtue of mold formed by the tape and the cavity walls of the printhead die.

In various implementations, a fluid feed slot/channel may be plunge-cut through the printed circuit board, either before or after the printhead die is embedded in the printed circuit board. In at least some implementations, forming the fluid feed slot/channel after the printhead die is embedded in the printed circuit board may provide a more mechanically robust structure into which the fluid feed slot/channel may be formed as compared to forming the fluid feed slot/channel into the printhead die without a printed circuit board, which may result in fewer cracks during the formation of the fluid feed slot/channel. In addition, handling of the printhead die may be facilitated by coupling the printhead die to the larger footprint printed circuit board. In other implementations, the printed circuit board may include the fluid feed slots before the printhead dies are embedded in the printed circuit board.

The method 1200 may proceed with electrically connecting at least one of the printhead dies to the conductor layer of the printed circuit board. In various implementations, the cover layer may include an opening exposing the bond such that the printhead die may be electrically connected to the bond pad through the opening. In various implementations, the printhead die may be electrically connected to the bond pad by at least one wire. The electrically connections may then be encapsulated in an encapsulant material. In some implementations, the printhead die may be electrically connected to the conductor layer, which may be a top or bottom surface of the printed circuit board, by way of a through-silicon via in the printhead die and one or more conductive pathways in the printed circuit board.

Various aspects of the illustrative embodiments are described herein using terms commonly employed by those skilled in the art to convey the substance of their work to others skilled in the art. It will be apparent to those skilled in the art that alternate embodiments may be practiced with only some of the described aspects. For purposes of explanation, specific numbers, materials, and configurations are set forth in order to provide a thorough understanding of the illustrative embodiments. It will be apparent to one skilled in the art that alternate embodiments may be practiced without the specific details. In other instances, well-known features are omitted or simplified in order not to obscure the illustrative embodiments.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. It is manifestly intended, therefore, that embodiments be limited only by the claims and the equivalents thereof.

What is claimed is:

1. A fluid ejection apparatus comprising:

a printed circuit board including a conductor layer, a cover layer forming a surface of the printed circuit board; and a printhead die electrically connected to the conductor layer and embedded in a molding material, the printhead die disposed in a cavity in the printed circuit board;

wherein the printhead die includes a through-silicon via extending to a bottom surface to electrically connect the printhead die to the conductor layer;

wherein the molding material embedding the printhead die is level with the cover layer.

2. The apparatus of claim 1, wherein the printhead die comprises a plurality of printhead dies arranged in a staggered, end-to-end pattern along a width of the printed circuit board.

3. The apparatus of claim 1, wherein the cover layer comprises a polymer.

4. The apparatus of claim 3, wherein the cover layer comprises polyimide, polyethylene naphthalate, or polyethylene terephthalate.

5. The apparatus of claim 1, wherein the cover layer is coupled to the conductor layer by an adhesive.

6. The apparatus of claim 1, wherein the cover layer comprises a polyimide film and an epoxy adhesive between the polyimide film and the conductor layer.

7. The apparatus of claim 1, wherein the cover layer is a first cover layer forming a first surface of the printed circuit board and wherein the printed circuit board includes a second cover layer forming a second surface, opposite the first surface, of the printed circuit board.

8. The apparatus of claim 1, wherein the printhead die comprises an arrangement of printhead die slivers each disposed in a corresponding cavity in the printed circuit board.

9. The apparatus of claim 1, wherein the printhead die comprises multiple die slivers.

10. The apparatus of claim 1, further comprising a fluid feed channel extending through a surface of the printed circuit board to deliver fluid to the printhead die.

11. A fluid ejection apparatus comprising:

a plurality of printhead dies;

a printed circuit board having a conductor layer and a cavity in which the plurality of printhead dies are disposed, the printhead dies being embedded in a molding material in the cavity; and a cover layer forming a surface of the printed circuit board and having an opening exposing a bond pad of the conductor layer, and wherein each of the plurality of printhead dies is electrically connected to the bond pad;

wherein the plurality of printhead dies are arranged end-to-end in two rows across the printed circuit board, and wherein placement of the printhead dies is staggered such that ends of the printhead dies overlap laterally between the two rows.

12. The fluid ejection apparatus of claim 11, wherein each of the plurality of printhead dies is electrically connected to the bond pad of the printed circuit board by a wire bond.

13. The fluid ejection apparatus of claim 12, wherein the fluid ejection apparatus further comprises an encapsulant material encapsulating the wire bond.

14. The fluid ejection apparatus of claim 11, wherein the molding material is level with the cover layer.

15. The fluid ejection apparatus of claim 11, wherein each printhead die includes a through-silicon via extending to a bottom surface of that die to electrically connect that printhead die to the conductor layer.

16. The fluid ejection apparatus of claim 11, wherein:

the plurality of printhead dies is a first plurality of printhead dies;

the printed circuit board comprises an elongated printed circuit board; and the apparatus includes a second plurality of printhead dies embedded in a molding material in another cavity of the printed circuit board.

17. A method for making a fluid ejection apparatus, comprising:

providing a printed circuit board including a conductor layer, a cover layer forming a surface of the printed circuit board, wherein the cover layer includes an opening exposing a bond pad of the conductor layer, and a cavity;

embedding a plurality of printhead dies in a molding material in the cavity, wherein the plurality of printhead dies are arranged end-to-end in two rows across the printed circuit board, and placement of the printhead dies is staggered such that ends of the printhead dies overlap laterally between the two rows, and wherein the molding material is level with the cover layer; and electrically connecting the printhead dies to the bond pad of the conductor layer.

18. The method of claim 17, further comprising, prior to said embedding the plurality of printhead dies, forming the cover layer over the conductor layer, and forming the cavity in the printed circuit board through the cover layer after said forming the cover layer over the conductor layer.

19. The method of claim 17, further comprising, prior to said embedding the printhead dies, forming the cover layer over the conductor layer, the cover layer including an opening corresponding to the cavity prior to said forming.

* * * * *